US005471194A

United States Patent [19]

Guscott

[11] Patent Number: 5,471,194

[45] Date of Patent: Nov. 28, 1995

[54] EVENT DETECTION SYSTEM WITH CENTRALIZED SIGNAL PROCESSING AND DYNAMICALLY ADJUSTABLE DETECTION THRESHOLD

[75] Inventor: John K. Guscott, Hickory, N.C.

[73] Assignee: Aritech Corporation, Hickory, N.C.

[21] Appl. No.: 35,978

[22] Filed: Mar. 23, 1993

[51] Int. Cl.[6] ..... G08B 25/14

[52] U.S. Cl. ..... 340/511; 340/501; 340/518

[58] Field of Search ..... 340/510, 511, 340/517, 518, 522, 501

[56] References Cited

U.S. PATENT DOCUMENTS

| | | | |
|---|---|---|---|
| 4,348,661 | 9/1982 | Lucchesi | 340/510 |
| 4,356,476 | 10/1982 | Healey et al. | 340/510 |
| 4,523,183 | 6/1985 | Frick | 340/511 |
| 4,524,349 | 6/1985 | Hyatt | 340/511 |
| 4,528,553 | 7/1985 | Hastings | 340/500 |
| 4,725,821 | 2/1988 | Kimura et al. | 340/510 |
| 4,782,330 | 1/1988 | Tindall et al. | 340/518 |
| 5,084,696 | 1/1992 | Guscott et al. | 340/311 |

OTHER PUBLICATIONS

Aritech Corp., "Premier Intelligence For All of Your Installation Needs", 11-page brochure.

*Primary Examiner*—John K. Peng

*Assistant Examiner*—Daniel J. Wu

*Attorney, Agent, or Firm*—Weingarten, Schurgin, Gagnebin & Hayes

[57] ABSTRACT

An event detection system with centralized signal processing and dynamically adjustable detection threshold includes a number of remotely located event detection units coupled to a single centralized signal processing unit. Each event detection unit provides an event detection signal to the centralized signal processing unit. At least one signal processor in the centralized signal processing unit compares the value of the event detection signal with a dynamically adjustable threshold value, and provides a first detection signal when the event detection signal exceeds the value of the dynamically adjustable threshold. A threshold generator compares the event detection signal and a predetermined offset value, and adjusts the value of the dynamically adjustable threshold as the event detection signal exceeds the offset value. The signal processor then provides a second event detection signal when the event detection signal exceeds the adjusted threshold value. The invention further includes a mutual event verifier located in the centralized signal processing unit, for establishing at least one of the event detection units as a mutual verification event detection unit, and for activating an alarm only upon the concurrence of a detection signal from the designated mutual verification event detection unit, and a second confirming detection signal from any other event detection unit coupled to the system.

17 Claims, 12 Drawing Sheets

EVENT DETECTION SYSTEM WITH CENTRALIZED SIGNAL PROCESSING AND DYNAMICALLY ADJUSTABLE DETECTION THRESHOLD

FIELD OF THE INVENTION

This invention relates to security systems and more particularly, to a security system with centralized event signal detection and processing employing dynamically adjustable detection thresholds and mutual event verification.

BACKGROUND OF THE INVENTION

Prior art sensors or detectors utilized in security systems are stand-alone devices which make alarm decisions on their own, at the detector or sensor head itself.

Such prior art devices suffer from several drawbacks including the expense of providing all of the functional redundancy of event detection signal processing in each and every sensor head. Providing sensor heads with such redundant functionality results in sensor heads which are complex systems including many parts and requiring many adjustments. Further, since each sensor head operates independently, it is often unknown if the head is functional. Further, often times wires from the head to an alarm panel may be cut or otherwise tampered with without alerting the system to such a problem.

An additional problem with prior art independent sensor heads is that true, independent multiple verification of an event cannot be provided. This results in a security system with less than desirable immunity to false alarm signals which often stem from false or unwanted signal sources.

SUMMARY OF THE INVENTION

This invention features an event detection system with centralized signal processing and dynamically adjustable detection threshold. The system includes a plurality of remotely located event detection units. Each of the event detection units includes at least one event detector providing an event signal having a variable value upon the detection of an event. The invention further includes a single, centralized signal processing unit, coupled to each of the remotely located event detection units.

In one embodiment the event detectors may be coupled to a current signal source, for converting the voltage event signals into an event detection current signal and the centralized signal processing unit may include a plurality of current-to-voltage signal converters. Each of the current-to-voltage signal converters is responsive to an event detector current signal provided by one of the event detection units, for converting the event detection current signal into an event detection voltage signal having a corresponding value. The single centralized signal processing unit further includes at least one event detection voltage signal processor, for processing the event detection voltage signal.

The event detection voltage signal processor includes a comparator, for comparing the value of event detection voltage signal with a dynamically adjustable threshold value having a predetermined initial value, and for providing a first detection signal upon the value of the event detection voltage signal exceeding the initial value of the dynamically adjustable threshold.

Coupled to the comparator is a threshold generator, which is responsive to the event detection voltage signal and to a predetermined offset value, for adjusting the value of the dynamically adjustable threshold, and for providing an adjusted threshold value to the comparator upon the value of the event detection voltage signal exceeding the predetermined offset value.

The adjusted threshold value increases as a function of increases in value of the event detection voltage signal. Further, the comparator then provides a second, confirming detection signal upon the event detection voltage signal exceeding the value of the adjusted threshold value. Alarm apparatus, coupled to the system and responsive to the second, confirming detection signal provides an indication of a detected and confirmed event.

In the preferred embodiment, the event detection voltage signal processor further includes at least one window timer, responsive to the first detection signal from the comparator, for providing an alarm activation period signal during which an alarm signal may be generated. Additionally, an alarm activator is coupled to the window timer and responsive to both the alarm activation period signal and to the second, confirming detection signal, for providing an alarm signal which activates the alarm apparatus thus indicating that an event has been detected and confirmed.

The preferred embodiment also includes a mutual event verifier, which is responsive to at least one mutual verification event detection unit selector signal, for establishing at least one of the event detection units as a mutual verification event detection unit. A mutual verification event detection unit activates the alarm apparatus only upon the concurrence of a second confirming detection signal from the event detection unit which has been established as a mutual verification event detection unit, and a second, confirming detection signal from any other event detection unit coupled to the event detection system.

In the preferred embodiment, the mutual event verifier includes a number of mutual event occurrence timers. Each mutual event occurrence timer is responsive to a second, confirming detection signal from an associated event detection unit, and responsive to a mutual verification event detection unit selector signal, for providing a mutual event detection period signal having a predetermined duration, and during which the alarm apparatus may be activated.

The mutual event verifier further includes a mutual event detector, coupled to each of the mutual event occurrence timers and responsive to at least one mutual event detection period signal and to the mutual verification event detection unit selector signal, for activating the alarm apparatus only upon the concurrence of the mutual event detection period signal and a second, confirming event detection signal from any other one of the event detection units. Absent any event detection unit established as mutual event detection units, the system operates normally whereby any unit producing a second, confirming event detection signal may trigger the alarm apparatus. Further, if mutual event verification is in use, any event detection unit not established or selected as a mutual event verification detection unit may generate, on its own, an alarm signal upon the occurrence of a second, confirming event detection signal.

In the preferred embodiment, the system includes a mutual event detection unit selector, which allows any coupled event detection unit to be selected and designated as a mutual verification event detection unit, and which provides the mutual verification event detection unit selector signal to the signal processor.

The remotely located event detection units may include heat detectors, intrusion detectors, smoke detectors, or other similar event detection devices. Further, the single, centralized signal processing unit may include one event detection voltage signal processor for each one of the remotely located event detection unit, or a single event detection voltage signal processor. Additionally, by monitoring the event detector or current signals which are then reconverted to event detection voltage signals, the present invention detects tampering with any one of the event detection units or the cable interconnecting each of the event detection units and the single centralized signal processor. Further, the alarm apparatus may provide one or the other or both of a visual or audible indication of a detected and confirmed event.

DESCRIPTION OF THE DRAWINGS

These, and other features and advantages of the present invention will be better understood by reading the following detailed description, taken together with the drawings wherein.

DETAILED DESCRIPTION OF THE INVENTION

Figure 1:
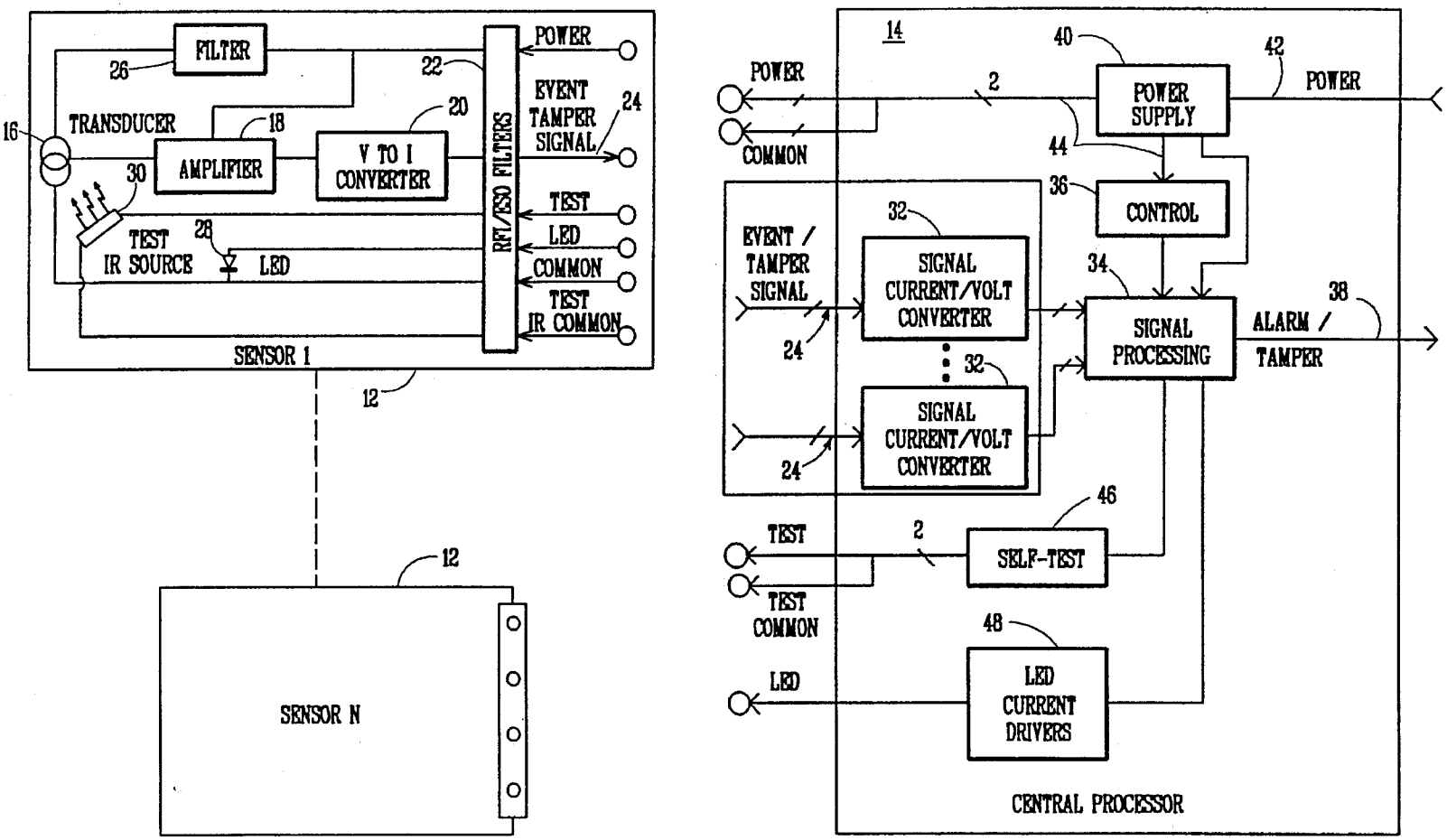
FIG. 1 is a block diagram of the event detection system according to the present invention.

Referring now to FIG. 1, an event detection system with centralized signal processing and dynamically adjustable detection threshold 10 includes a plurality of remotely located event detection or sensor units (heads) 12. Each of the remotely located event detection units 12 is coupled to a single centralized signal processing unit 14 by means of individual cables or wires (not shown) having a length of up to at least 500 feet. The centralized signal processing system may operate in a time division multiplex mode and thus is able to control as many sensors included in the system.

Each of the plurality of remotely located event detection units 12 include at least one event detector 16 such as a heat or infrared sensor, although other detectors such as ultrasonic, acoustic glass break and strain gauge are within the scope of the present invention. The event detector 16 provides a signal to an amplifier 18 which amplifies and otherwise conditions the event detection voltage signal prior to providing the signal to a voltage-to-current converter 20.

Voltage-to-current converter 20 converts the amplified voltage signal from the event detector 16 into a current signal. Indeed, all electronic signalling between the event detection units and the control processor is carried out in current mode. Since each of the event detection units are remotely located from the signal processor, current signaling provides superior transient immunity over traditional voltage signaling for the transmission of analog data over long wires. The current signal produced by voltage-to-current converter 20 then passes through an RFI/ESD filter 22 prior to traveling on signal path 24 to the centralized processor 14.

Additionally, each of the remotely located event detection units 12 includes a power line filter 26, and an LED 28 which indicates that the event detection unit is functioning properly. The LED 28 is activated by a five milli-ampere current provided by a five milli-ampere current driver 48 in the centralized processor 14 as will be explained in greater detail below. This current signal ensures a constant illumination and current consumption independent of transmission line losses. The LED 28 may be illuminated in a steady state or in a pulsed mode according to various purposes of the signal. For example, the LED driver 48 may be programmed to cause the LED 28 to blink during system power-up to keep the installer cognizant of the system's condition. Further, various blinking LED codes may be used to differentiate between various system errors. Since the LED driver 48 is resident in the centralized processor 14, any system trouble codes being reported by the LED 28 are also available to the centralized processor 14 and/or a system control panel for further processing as appropriate by the overall system 10.

A test source 30 which allows the unit to be self-tested remotely, from the centralized signal processor 34, may optionally be included. In the embodiment wherein the event detector 16 is a heat or infra-red sensor, test source 30 may include a heater which is used to irradiate the pyroelectric detector 16 upon command from the centralized processor 14. Infrared test source 30 may be provided as a separate part directly irradiating the detector, or as a separate part with its own optical subsystem to focus energy onto the detector, or as a built-in part within the body of the detector 16 itself. Further, the test source 30 may be utilized to calibrate the event detection unit. In this case, wherein precision is important, locating the test source 30 within the body of the detector 12 will provide greater precision. For other detector technologies, the infrared test source 30 would be substituted by a test source suitable to the sensing technology. For example, the acoustic glass break sensor would utilize an ultrasonic test source.

The event detection units 12 may be connected to the centralized processor 14 by means of a six pin telephone type plug and jack. If the overall system requirements do not specify the use of a test source, a six/four wiring plug may be used with four conductor cable. If a test source is specified, six conductor cable will be utilized. To avoid any problems associated with possible connector polarity, the event detection unit jack may be wired in reverse order to the jack in the centralized processor. This will allow the system installer to always use the same protocol whenever a connector is applied to the cable. To avoid damage to the system hardware, if a jack is inadvertently connected backwards, the following wiring order is proposed for the jacks:

TABLE I

| Detection Unit | | Central Processor | | |
|---|---|---|---|---|
| 4 | 6 | 4 | 6 | Signal ID |
| B | 1 | B | 6 | Test Common |
| 1 | 2 | 4 | 5 | Common |
| 2 | 3 | 3 | 4 | Vcc |
| 3 | 4 | 2 | 3 | LED |
| 4 | 5 | 1 | 2 | Signal/Tamper |
| B | 6 | B | 1 | Test Source |

In TABLE I the reference character "B" indicates an unfilled or blank position in the 6/4 connector.

Centralized signal processor 14 includes a plurality of current-to-voltage signal converters 32 (only one shown), one for each signal. Each of the current-to-voltage signal converters 32 receives one current signal from one of the plurality of event detection units 12. Current-to-voltage signal converter 32 converts the current signal to a voltage signal which is provided to signal processing unit 34. Signal processing unit 34 processes the voltage event signal and, under control of control unit 36, provides an alarm/tamper activation signal 38 to an alarm apparatus typically located in a local or remote alarm control panel.

Centralized signal processing unit 14 also typically includes power supply 40 which receives unfiltered power over signal path 42 from a control panel or other source of power and provides a filtered power supply output at the proper voltage level over signal path 44 to each of the individual remotely located event detection units 12 as well as to centralized processor 14.

Centralized signal processing unit 14 further includes self-test circuitry 46 and LED current driver circuitry 48 (only one shown of each) which provide the appropriate LED and test current signals to each of the individual event detection units. In addition to the uses for the LED circuit explained above, self-test circuitry 46 may be utilized to calibrate the individual event detection units.

Figure 2:
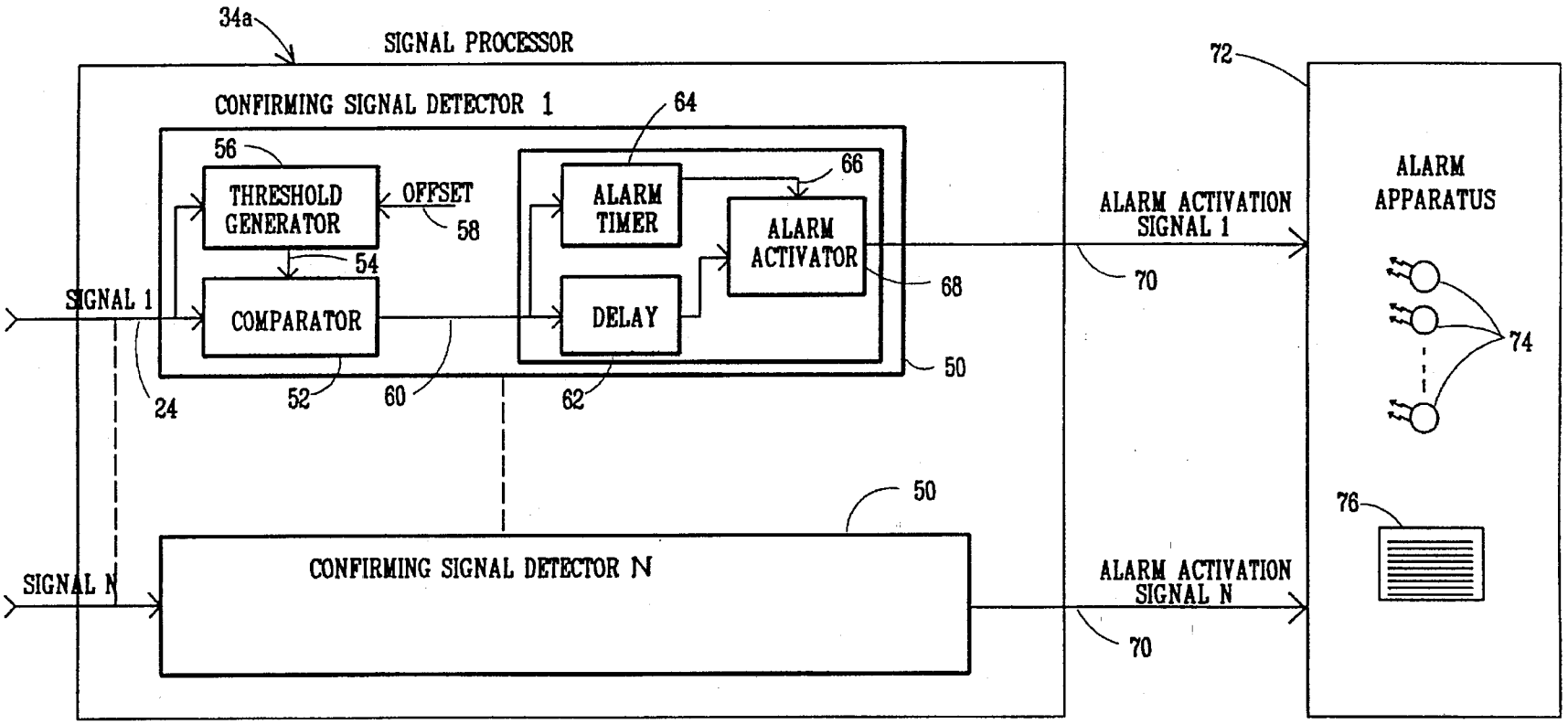
FIG. 2 is a block diagram of one embodiment of the centralized signal processor with dynamically adjustable detection threshold according to one embodiment of the present invention.

One embodiment of signal processor 34 of the centralized signal processing unit 14 of the present invention is shown in FIG. 2 wherein signal processor 34a includes a plurality of event detectors 50. Each of the event detectors 50 is responsive to a reconverted voltage signal 24 from one of the event detection units 12. Each of the signal detectors 50 include a detection comparator 52 which compares the input signal 24 with a dynamically adjustable threshold 54 provided by threshold generator 56.

The dynamically adjustable threshold value 54 is provided by threshold generator 56 as a function of input signal 24 and a predetermined initial off-set value 58. Threshold generator 56 adjusts the value of the dynamically adjustable threshold 54 and provides an increased threshold value as a function of increases in input signal 24. Such a dynamically adjustable detection threshold circuit is described in greater detail in U.S. Pat. No. 5,084,696 assigned to the assignee of the present invention and incorporated herein by reference. When the input signal level decreases, the dynamically adjustable threshold value 54 decays as a result of an RC time constant. Alternatively, threshold generator 56 may be reset to the initial threshold value by the passing of a predetermined period of time.

Detection comparator 52 provides set and reset signals over signal path 60 to delay circuitry 62 and alarm timer 64. Alarm timer 64 is responsive to a set signal 60 from comparator 52 and provides an alarm timing signal 66 to alarm activator 68. Thus, a first event signal from the event detection unit which exceeds the initial dynamically adjustable threshold value will cause comparator 52 to provide a first event detection signal thus enabling alarm activator 68. A second and subsequent confirming signal from detection comparator 52 during the period of the alarm timer signal 66 activates alarm activator 68 and provides alarm activation output signal 70 to alarm apparatus 72. Alarm apparatus 72 may include a plurality of visual alarm indicators 74, an audible alarm indicator 76 or combinations thereof.

Figure 3:
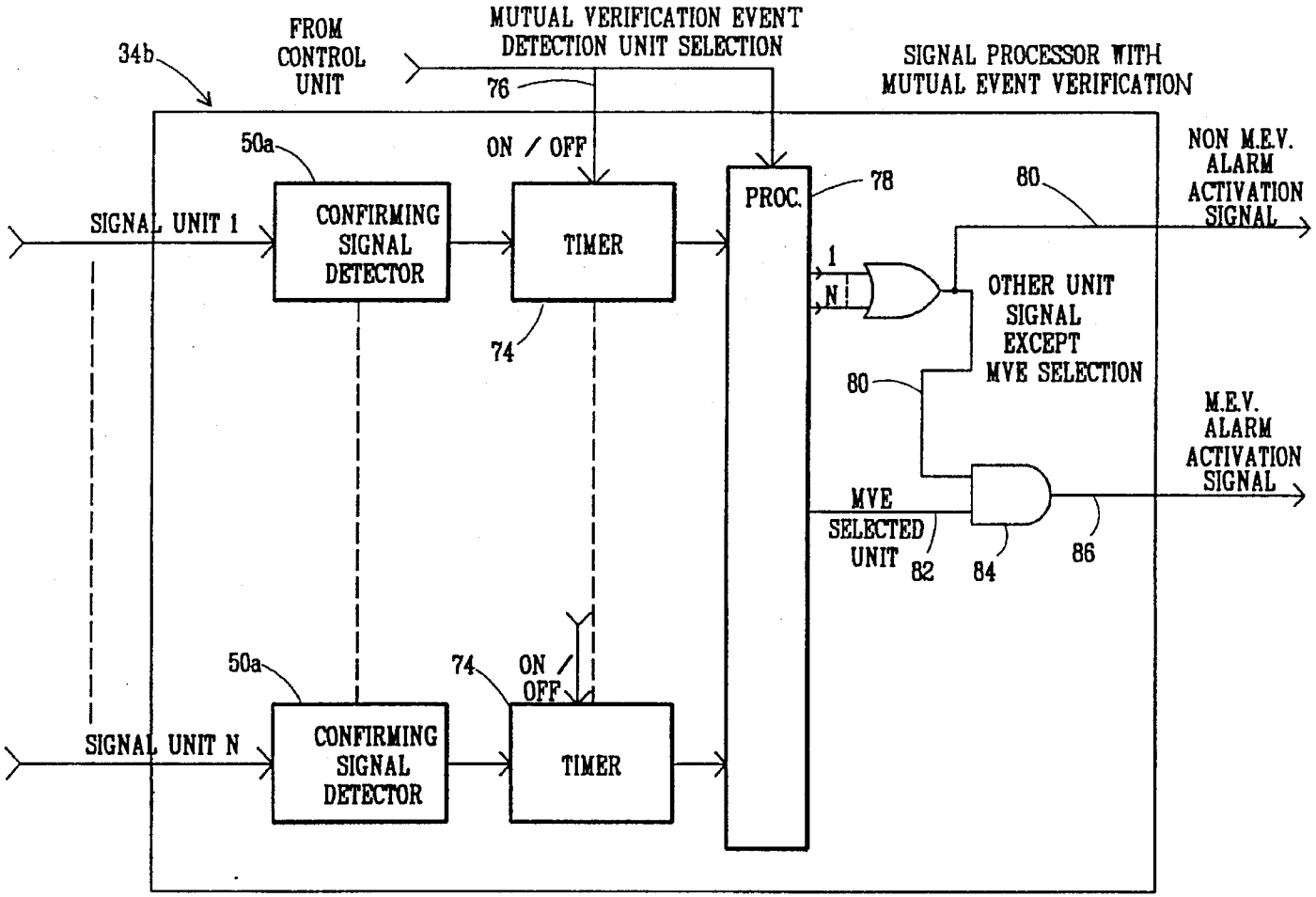
FIG. 3 is a block diagram of a signal processor implementing mutual event verification according to yet another embodiment of the present invention.

An additional embodiment of the signal processor which forms part of the central processing unit of the present invention is shown in FIG. 3 wherein signal processor **34*b*** implements mutual event verification.

Mutual verification refers to a mode of operation wherein any or all of the plurality of event detection units 12 (FIG. 1) may be selected to be "first detection" detectors. A "first detection" detection unit may start an alarm verification sequence but cannot complete it. Verification is accomplished by any other detection unit in the system within a validation time window initiated by any "first detection" detection unit. It is important that a "first detection" sensor or detection unit cannot validate or verify itself, for then a faulty sensor or faulty detector installation may generate false alarm signals.

If all of the detection units are designated as "first detection" and thus operated in the mutual verification mode, no one detector is ever capable of issuing an alarm, either wanted or unwanted. If no event detector is designated "first detection", then the system functions in a conventional manner. If some event detectors are designated in the mutual verification mode, then those detectors so designated may start a verification sequence which can then be completed by any other detector. Those event detectors not designated as operating in the mutual verification mode will function as normal detectors and as validation detectors.

Therefore, a signal processor with mutual event verification includes a plurality of confirming signal detectors **50*a* which in this embodiment are identical to those disclosed above in conjunction with FIG. 2, although this is not a limitation of the present invention. The confirming signal detectors 50*a* provide a second, confirming event detection signal (which in the embodiment in FIG. 2, would correspond to the alarm activation signal) to mutual event verifier timers 74. The signal processor with mutual event verification 34*b* is adapted to selectively enable or disable mutual event verification. Enabling or disabling mutual event verification is provided by mutual verification event detection unit selection signal 76 provided from the control unit 36, FIG. 1**, of the centralized signal processor of the present invention.

The signal processor with mutual event verification **34*b* according to the present invention further includes a processing device 78 which may be provided for example as a microprocessor. Processing device 78 is responsive to control signal 76 identifying one or more event detection units as mutual event verification detectors. Thus, a mutual verification event detection unit selection signal 76 will enable or turn on mutual event verification timer 74 associated with the given event detection unit. If mutual event verification is not enabled for a particular event detection unit, the confirming signal from detector 50***a* will be allowed to immediately pass through timer 74, without delay.

In operation, once processing device 78 detects an incoming signal from one or more of timers 74, the processing device 78 determines whether or not the event detection unit associated with the given signal has been selected as a mutual event verification detector. If the given event detector unit producing the input signal has not been identified as a mutual event verification detector, the processing device 78 outputs a corresponding signal to provide a non-mutual event verification alarm activation signal 80. A similar signal from any other non-mutual event verification detector will also provide alarm activation signal 80.

If, on the other hand, the incoming signal has been generated and confirmed by a mutual event verification detector, processor unit 78 provides a mutual event verification enable signal 82 to mutual event verification logic 84. In such cases, processor unit 78 awaits a second signal from any other event detection unit except that detection unit which has been established as a mutual event verification unit and which generated the first event signal. Processor unit 78 looks for such a second signal during the time that the appropriate timer 74 is enabled. Timers 74 may provide an output signal having a duration up to several minutes, based upon the requirements of the system and the user.

Therefore, if any other signal is received from another event detector during the time period of the appropriate timer 74, processor unit 78 provides output signal 80 to mutual event verification circuit 84. Thus, the combination of a non-mutual event verification signal 80 occurring during time period of the mutual event verification selection signal 82 will cause mutual event verification circuitry 84 to provide mutual event verification alarm activation signal 86. Both mutual event verification and non-mutual event verification alarm signals are provided to an alarm apparatus for appropriate alarm activation as described above and well known in the art.

Figure 4:
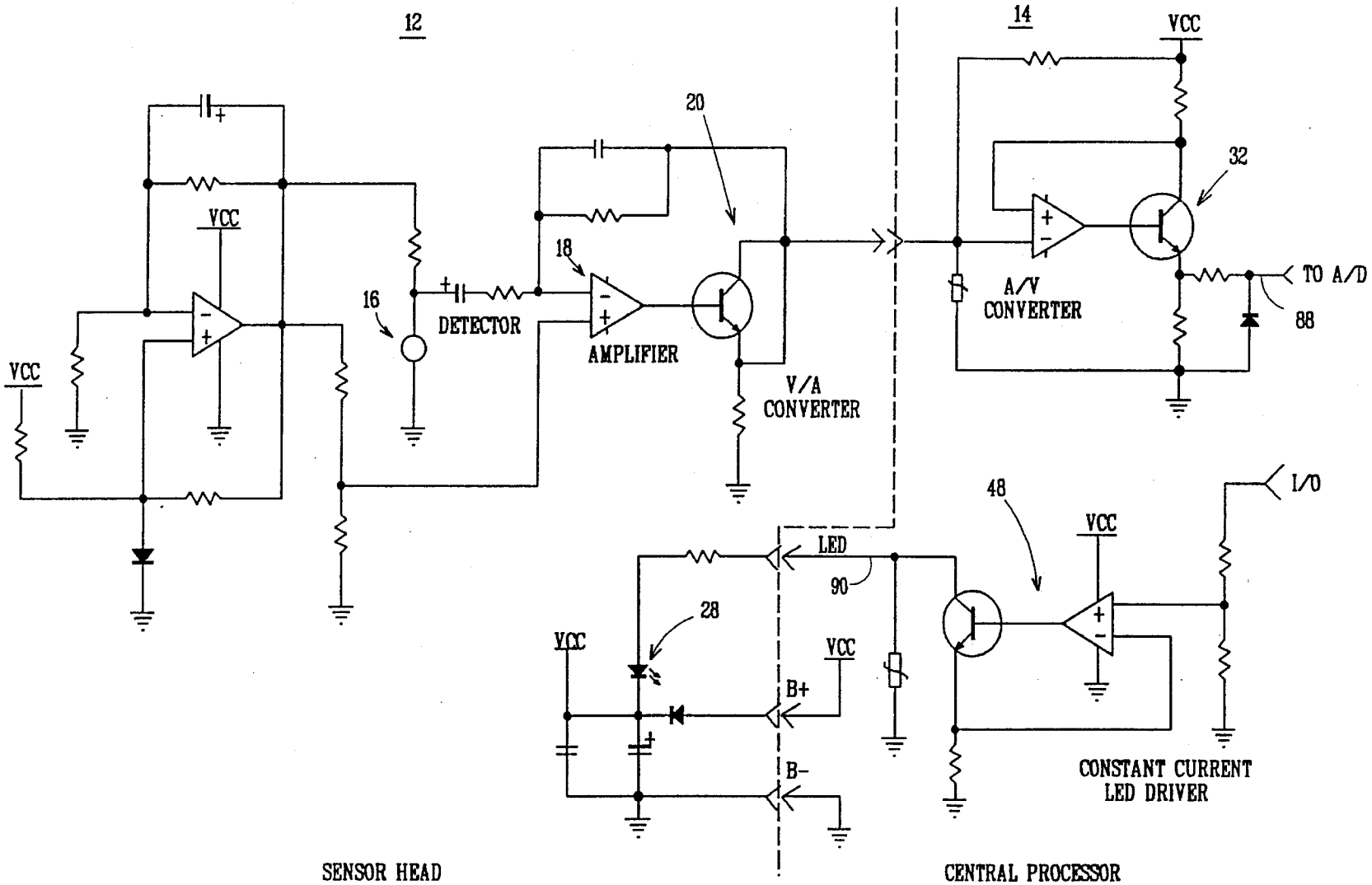
FIG. 4 is a schematic diagram of a portion of the circuitry of one implementation of an event detection unit of the present invention, and a portion of the circuit of the centralized signal processor according to the present invention.

FIG. 4 provides a schematic of one implementation of an analog version of the event detection apparatus of the present invention wherein similar reference numerals correspond to the same or similar devices in FIG. 1. Accordingly, the detection unit 12 includes a detector 16 which provides an output voltage signal to amplifier 18. The voltage signal provided by amplifier 18 is converted to a current signal by voltage to current converter 20. The signal is coupled to a current-to-voltage converter 32 from which the re-converted voltage signal 88 is provided to an event detection circuit as described in U.S. Pat. No. 5,084,696 previously mentioned and incorporated by reference, or to an analog-to-digital converter (not shown) to be processed by a digital signal processor as will be further described below.

Also shown is LED current driver circuit 48 which provides a current signal 90 to drive LED 28 in the associated event detection unit 12.

Figure 5:
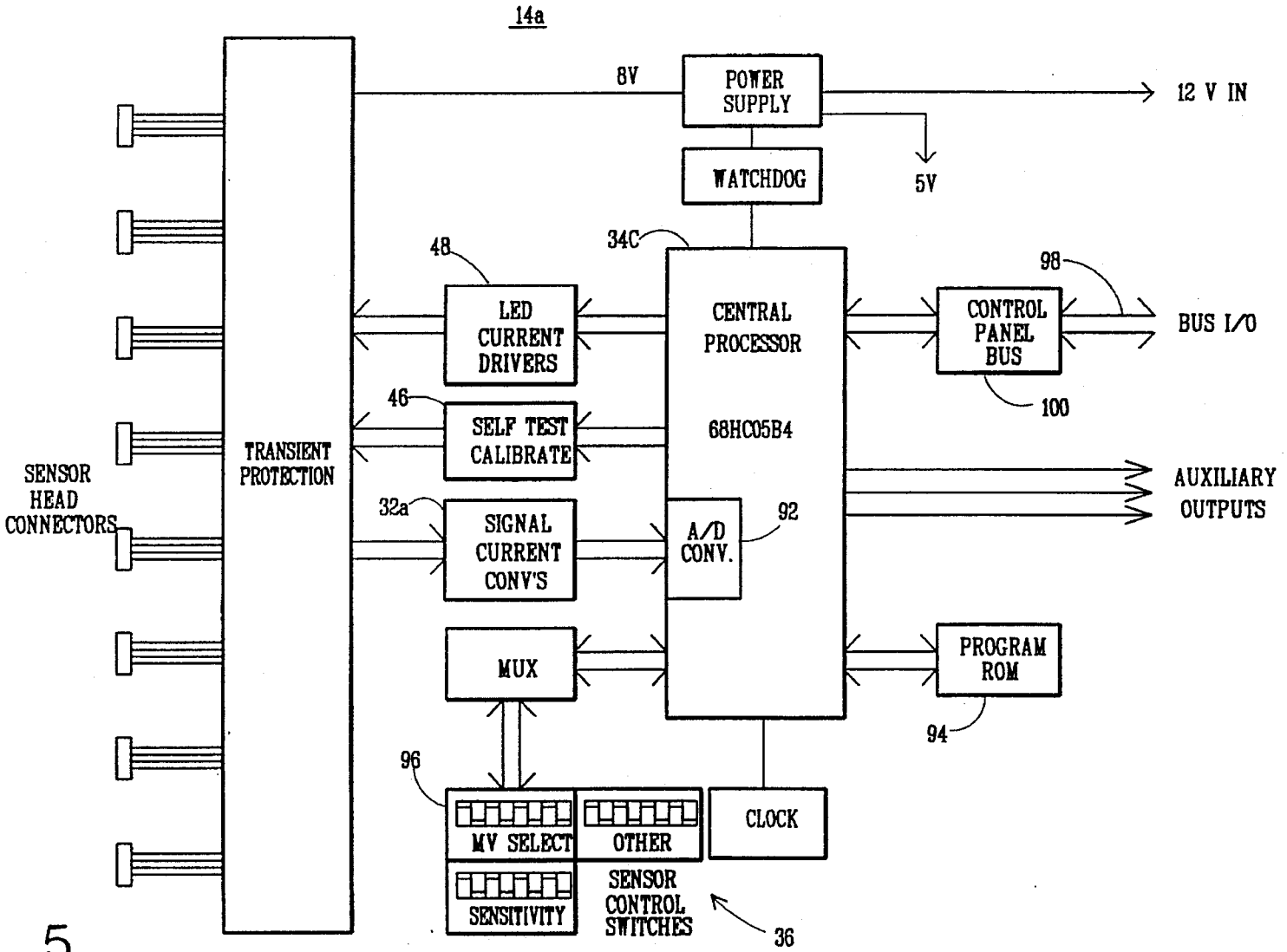
FIG. 5 is a block diagram illustrating a digital centralized signal processor according to yet another embodiment of the present invention.

In addition to the analog signal processing embodiment described above, the present invention also contemplates a digital signal processing embodiment as shown by digital signal processor 14*a*, FIG. 5 which includes central signal processor 34*c* which in this embodiment includes a 68HC05B4 central processor manufactured by Motorola having a built in analog-to-digital converter 92, although similar processors with external, independent analog-to-digital converters are also contemplated by this embodiment.

The analog-to-digital converter 92 is coupled to each of the event detection signal current-to-voltage converters 32*a*, for converting the voltage or analog signal to a digital signal. Under control of program ROM 94 and control devices 36 such as mutual verification selection switches 96, central processor 34*c* processes the incoming event detection signal(s) and outputs one or more alarm activation signals over bus 98 to a centralized alarm apparatus (not shown). In addition, as previously described, central processor unit 34*c* provides the appropriate signals to LED current drivers 48 and self-test calibration circuit 46 to energize the appropriate LED's and self-test features of the selected event detection units. Also included may be a control panel 100 coupled to bus 98 to control features of the system such as self-test calibration.

Figure 6:
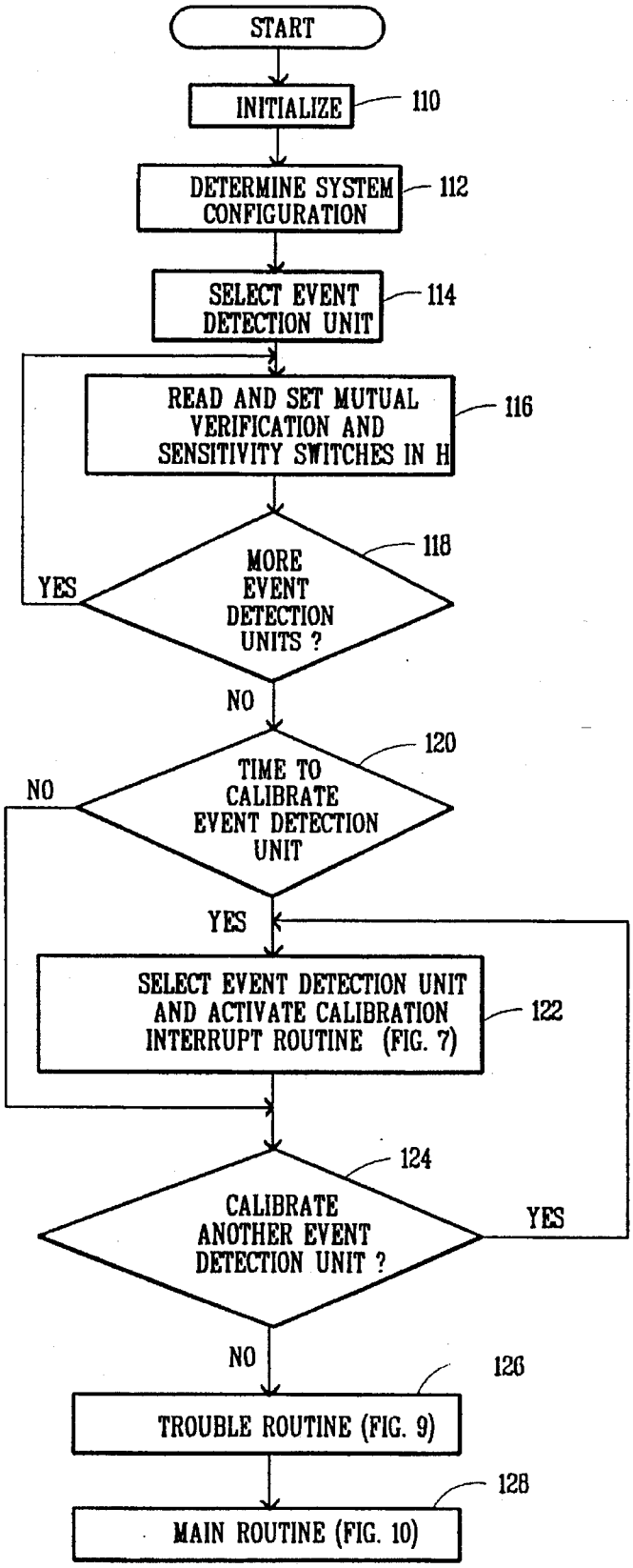
FIG. 6 is a flow diagram detailing the operation of a digital centralized signal processor according to one embodiment of the present invention.

Referring now to FIG. 6, a flow diagram of the processing performed in the central processor 14 (FIG. 1) for example upon "power up" of the system 10 is shown. In each of the flow diagrams described in conjunction with FIGS. 6–11 below, the rectangular elements (typified by element 110 in FIG. 6) herein denoted "processing blocks", represent computer software instructions or groups of instructions. The diamond shaped elements (typified by element 118 in FIG. 6) herein denoted "decision blocks," represent computer software instructions or groups of instructions which effect the execution of the computer software instructions represented by the processing blocks.

The flow diagrams of FIGS. 6–11 do not depict syntax of any particular computer programming language. Rather, the flow diagrams illustrate the functional information one of ordinary skill in the art requires to generate computer software to perform the processing required of the central processor. It should be noted that throughout the several flow diagrams described below, many routine program elements, such as initialization of loops and variables, the use of temporary variables, etc., are not shown.

Turning now to FIG. 6, when power is initially applied to the system 10 (FIG. 1) the processor, as shown in processing block 110, initializes any variables and causes the light emitting diode (LED) indicators in the central processor and in each one of the event detection units 12 (FIG. 1) to blink until the system 10 is ready to use. The blinking LEDs indicate to an installer that the system has power applied and is in the process of performing a set up procedure. The time required for system set up may range from several seconds to several minutes for a PIR sensor, for example.

Processing block 112 reads the system configuration to determine, inter alia, the number of event detection units which are coupled to the system. Processing blocks 114 and 116 and decision block 118 implement a loop wherein each of the event detection units are selected and a mutual verification selection switch 96 (FIG. 1) of each are interrogated and may be set to a predetermined value. Decision block 120 determines if it is time to calibrate any of the event detection units.

If decision is made to calibrate one or all of the event detection units, then processing block 122 and decision block 124 implement a loop in which each event detection unit may be calibrated. When no calibration is to be performed, or after all calibrations have been performed, processing block 126 implements a trouble routine upon completion of which program control continues to a main routine. The trouble and main routines will be described further below in conjunction with FIGS. 8 and 9 respectively.

Thus, in general overview, during the system power up routine the processor determines how many event detection units are present in the system configuration and determines the initial settings and selected mode of operation for each of the event detection units. The power up routine also tests and calibrates the event detection units.

In some applications, it may be useful to include a learn switch which may be set to indicate a learn mode. The learn mode may be used by an installer when the installer wishes to learn new calibration settings.

Upon completion of such a learning period, the learning switch may be turned off. Thus, a memory of the initial power up may be permanently retained even if the system is subsequently powered down. If the learn switch is not used on subsequent power ups the original settings may be retained.

Figure 7:
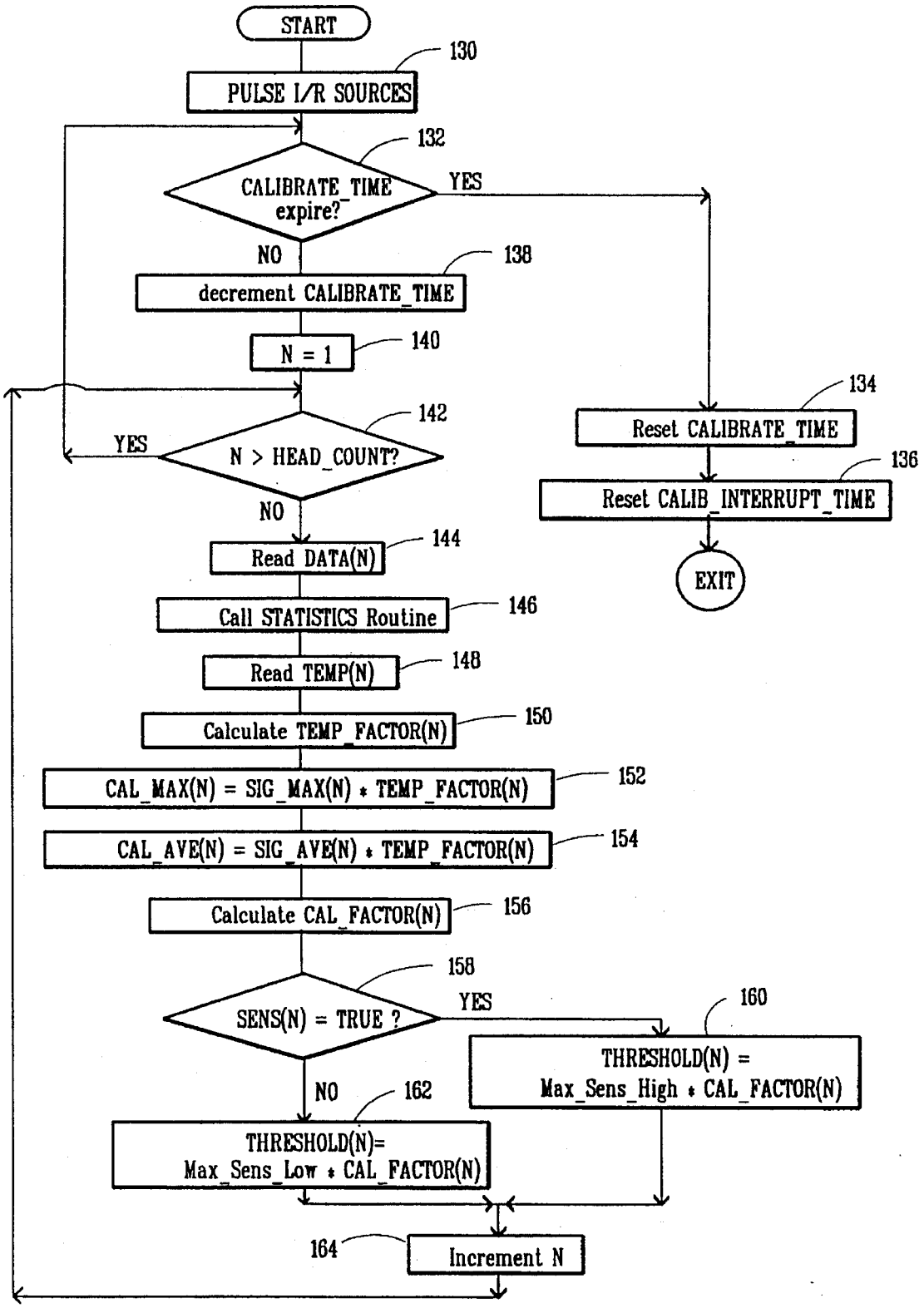
FIG. 7 is a flow diagram of the processing performed by a central processor according to one embodiment of the invention to perform a calibration routine.

Referring now to FIG. 7, the flow diagram shows processing steps performed in the processor to complete the calibration routine. It should be noted that the calibration routine may be activated from the main signal processing loop or activated periodically from the calibration interval timer input/output interrupt routine. Thus, the calibration routine may operate as a background function which is independent of the main signal processing loop. The calibration interval may be set for any appropriate time, for example the time may be set from any period between once per day and once per month.

In processing block 130 the IR sources are pulsed. Decision block 132, processing block 138, 140 and decision block 142 implement a loop in which the calibration time is measured. If the time allowed for calibration expires, then as shown in processing blocks 134 and 136 the calibration interrupt time is reset and the calibration routine is terminated. If the calibration time has not yet expired and all of the event detection units have not been interrogated then as shown in processing block 144, data is read from a particular one of the event detection units in response to the pulsed IR source.

In processing block 146 a statistics routine is implemented. The statistics routine will be described further below in conjunction with FIG. 8. Suffice it here to say that the statistics routine computes among other things, an average value of signals in the system.

Processing blocks 148–154 implement a series of steps in which data is read, computed and stored. In processing block 156 a calibration factor is computed. The computation of the calibration factor includes but is not limited to temperature factors, calibration signal factors and average calibration factors as provided in steps 148–154.

In response to settings within an event detection unit, the sensitivity switch will have a logical value corresponding to either true or false. Thus, as shown in decision block 158 if the sensitivity switch has the logical value true, a threshold is computed using the highest maximum sensitivity value. If the sensitivity switch has the logical value false, the lowest maximum sensitivity value is used to compute the threshold value.

In decision block 164, if each of the event detection units have not yet been calibrated then the next event detection unit is selected in and the calibration is performed for that detection sensor unit.

Figure 8:
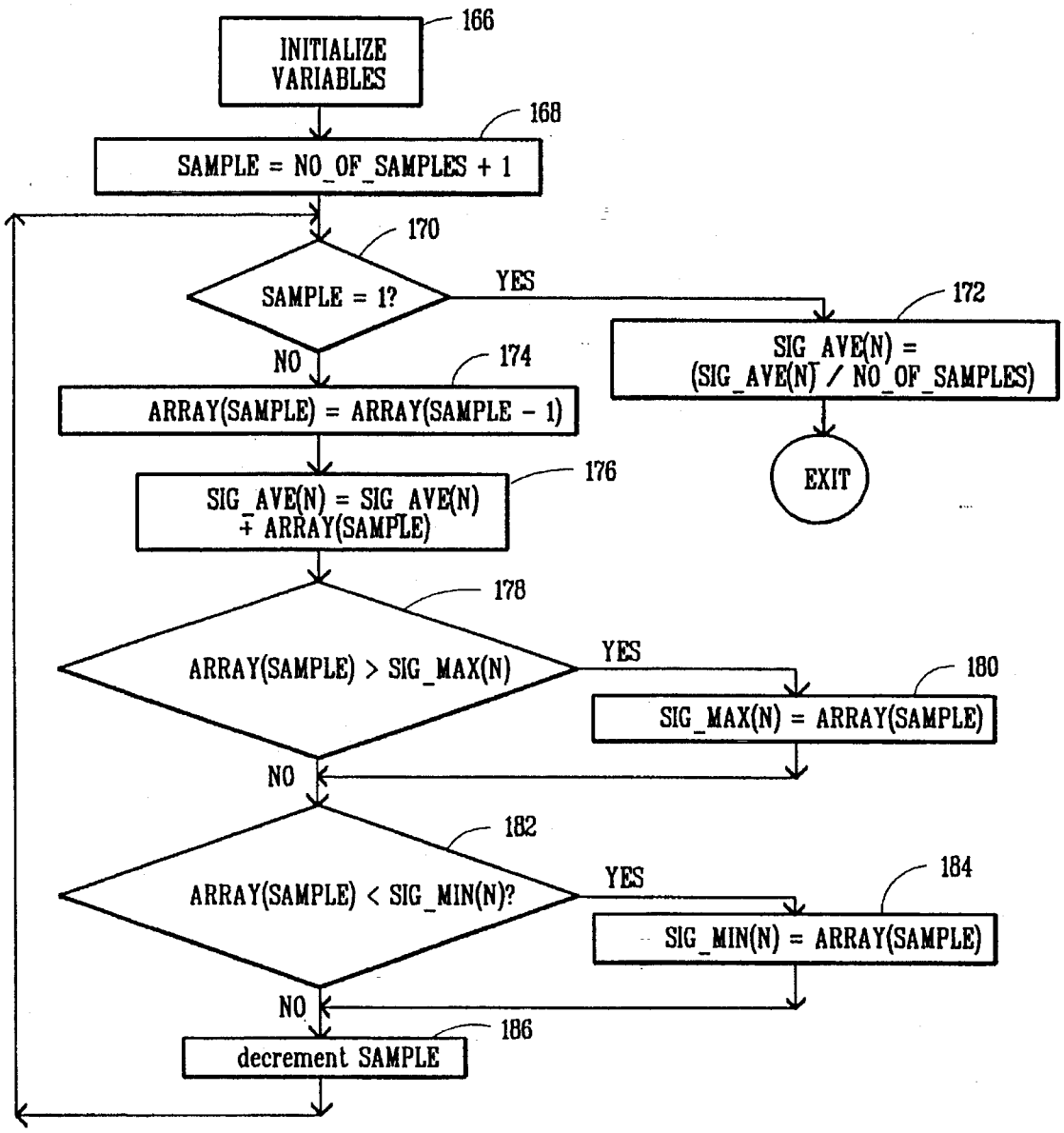
FIG. 8 is a flow diagram of the processing performed by a central processor according to one embodiment of the invention to compute the average value of a sampled signal.

Referring now to FIG. 8, the processing steps to compute a so-called moving average are shown. The moving average corresponds to an average signal value which is continuously updated. In processing block 166 a plurality of variables such as the average of the sampling period, the maximum value measured during the sampling period, the minimum value of the sampling period and an array of samples are initialized. In processing block 168 the number of samples NO_OF_SAMPLES in the moving average is known. In decision block 170 if all the samples have been considered then the signal average of the sampling period is computed as shown in the processing block 172 and the subroutine is terminated.

If all of the samples have not been considered then as shown in processing steps 174 and 176, the value in the array is updated and a new signal average is computed corresponding to the current signal average added to the array sample. The value of the current sample in the array is compared with a previously measured signal corresponding to a maximum signal value. If the value of the current sample is greater than the SIG_MAX value then the value of the current signal becomes the new SIG_MAX value.

Similarly, the value of the current sample in the array is compared with a previously measured signal corresponding to a minimum signal value. If the value of the current sample is less than the SIG_MIN value then the value of the current signal becomes the new SIG_MIN value.

Processing block 186 implements a loop in which the sample is decremented such that each sample in the array of samples is considered in the calculation of the moving average. Thus, the statistics routine includes an array variable which contains the components of the moving average. Each time the processing is performed, the components in the array are moved into the next higher position in the array and the first element of the array is overwritten with new data.

In the illustrative flow diagram of FIG. 8, a simple moving average of each detector sensor unit is maintained. As mentioned above, the average may also be given a weighting factor to reduce the significance of the samples as they are transferred upwards in the array. For example, cosine weighting may be used.

Figure 9:
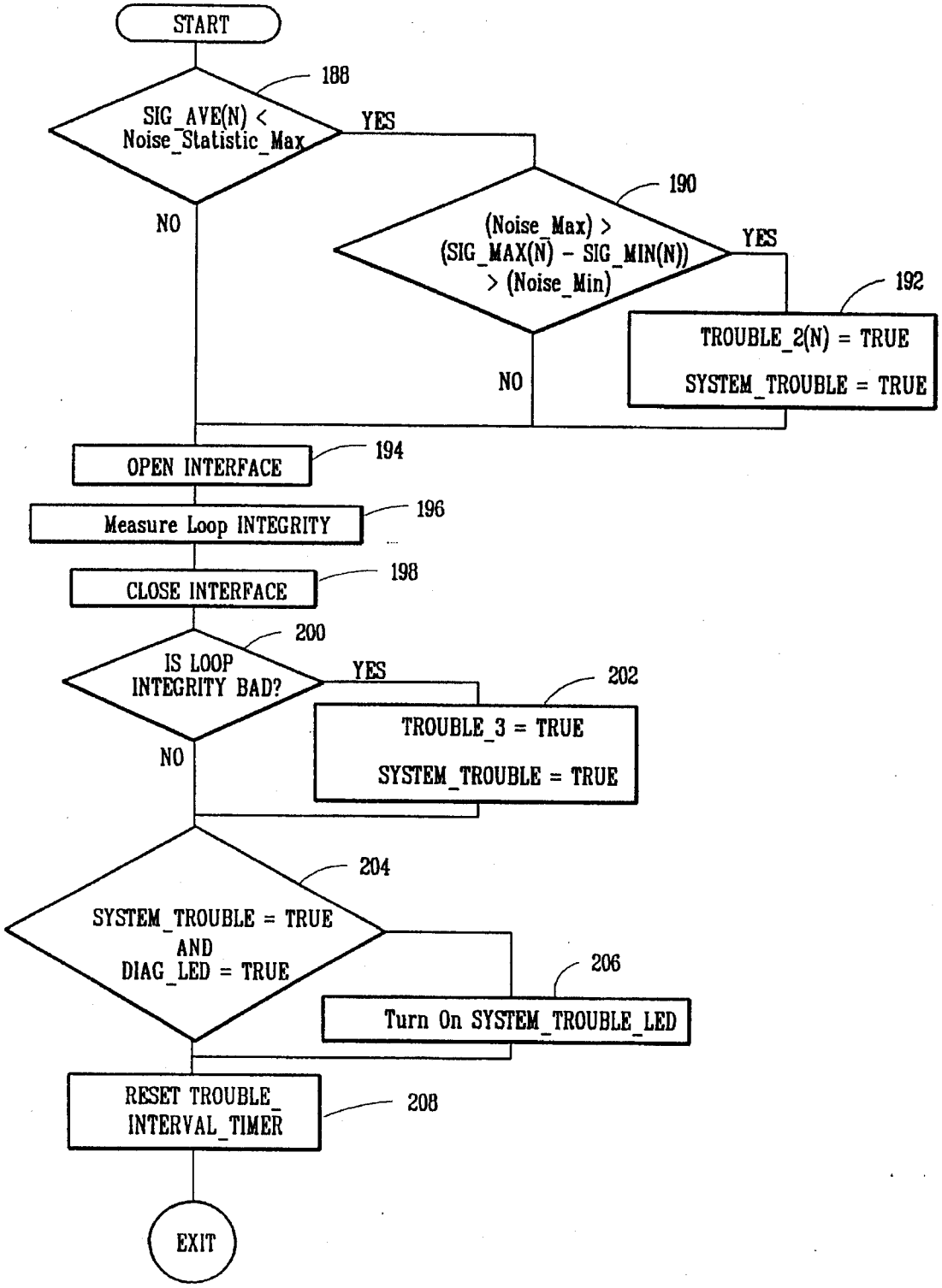
FIG. 9 is a flow diagram of the processing performed by a central processor according to one embodiment of the invention to analyze the statistics and test the various interfaces.

It should be noted that the moving average is a continuous function which may be used to diagnose trouble when the trouble routine to be described below in conjunction with FIG. 9 is called. Likewise the signal maximum and minimum values are maintained for the same number of samples as the moving average and in all cases the oldest data held in the array is removed from the array. Thus, the oldest value is no longer used in the computation of the average.

Referring now to FIG. 9, the processing steps of the trouble routine used to analyze the statistics and test the various interfaces is shown. In decision block 188, the signal average of the sampling period is compared to the threshold value for the true noise. If the signal average is greater than the threshold value, then, as shown in decision block 190, a difference value corresponding to the difference between the maximum signal value of the sampling period and the minimum signal value of the signal period is compared with the value of the maximum threshold noise and the minimum threshold noise value.

If the difference value is between the values of the maximum and minimum noise values then logical flags are set as shown in processing block 192 to indicate that a potential trouble spot may exist. Otherwise no logical flag is set and processing continues to processing blocks 194–198 in which an interface is opened, the loop integrity is measured and the interface is subsequently closed.

Based on the processing which occurs in processing blocks 194–198, decision is made in decision block 200 as to the integrity of the loop. If decision is made that the loop integrity is bad then as shown in processing blocks 202 an indication of an unstable environment or an internal component failure is made or alternatively an indication is made that there is trouble with the interface integrity.

Processing continues to decision block 204 where logical flags are checked to see if trouble exists. If the logical flags are set to indicate trouble then as shown in processing block 206 the system trouble LED is turned on and processing continues to processing block 208 where the trouble interval timer is reset before the subroutine terminates.

Figure 10:
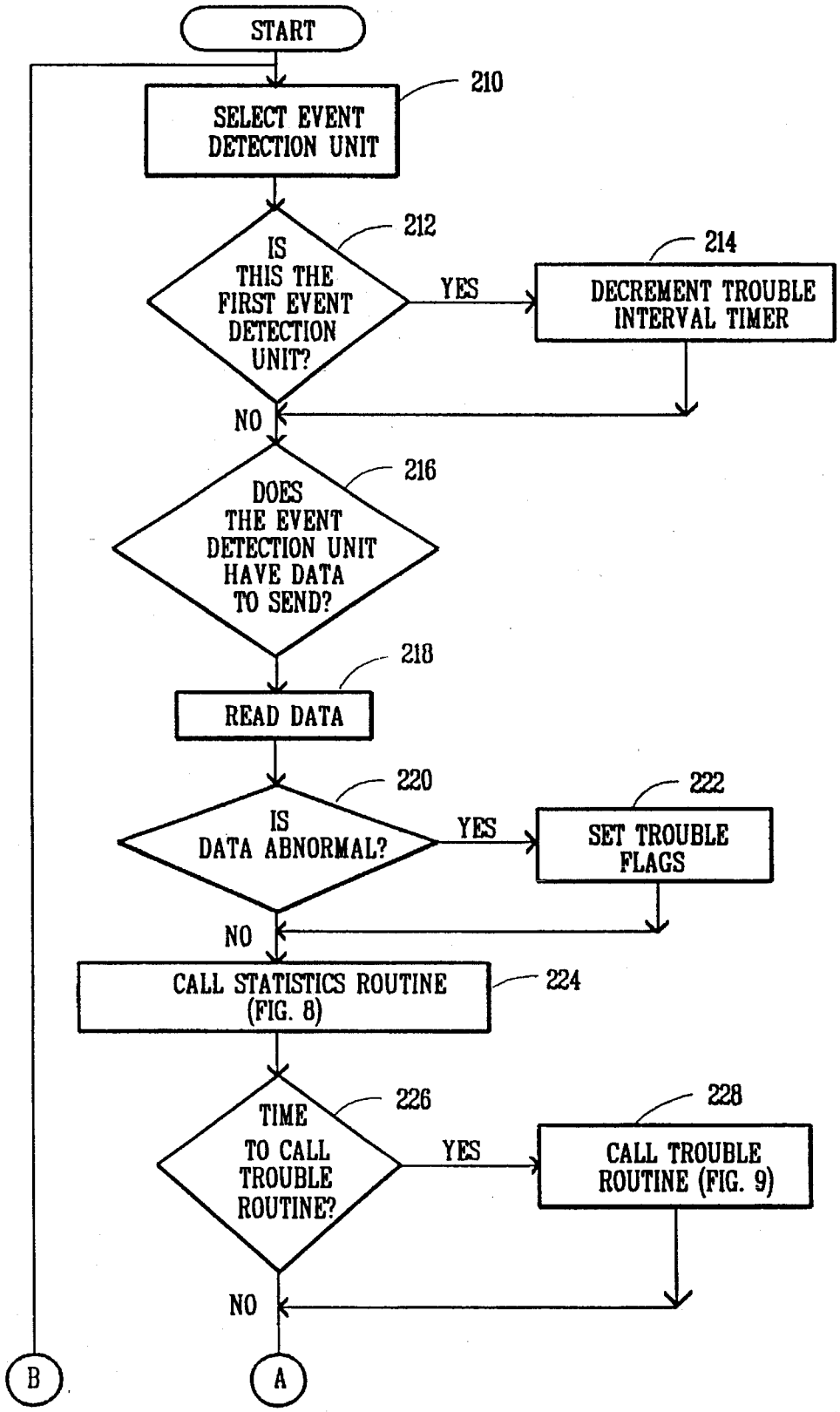
FIGS. 10 and 10A are a series of flow diagrams of the processing performed by a central processor according to one embodiment of the invention to monitor the heads and analyze the signals obtained therefrom.
Figure 10A:
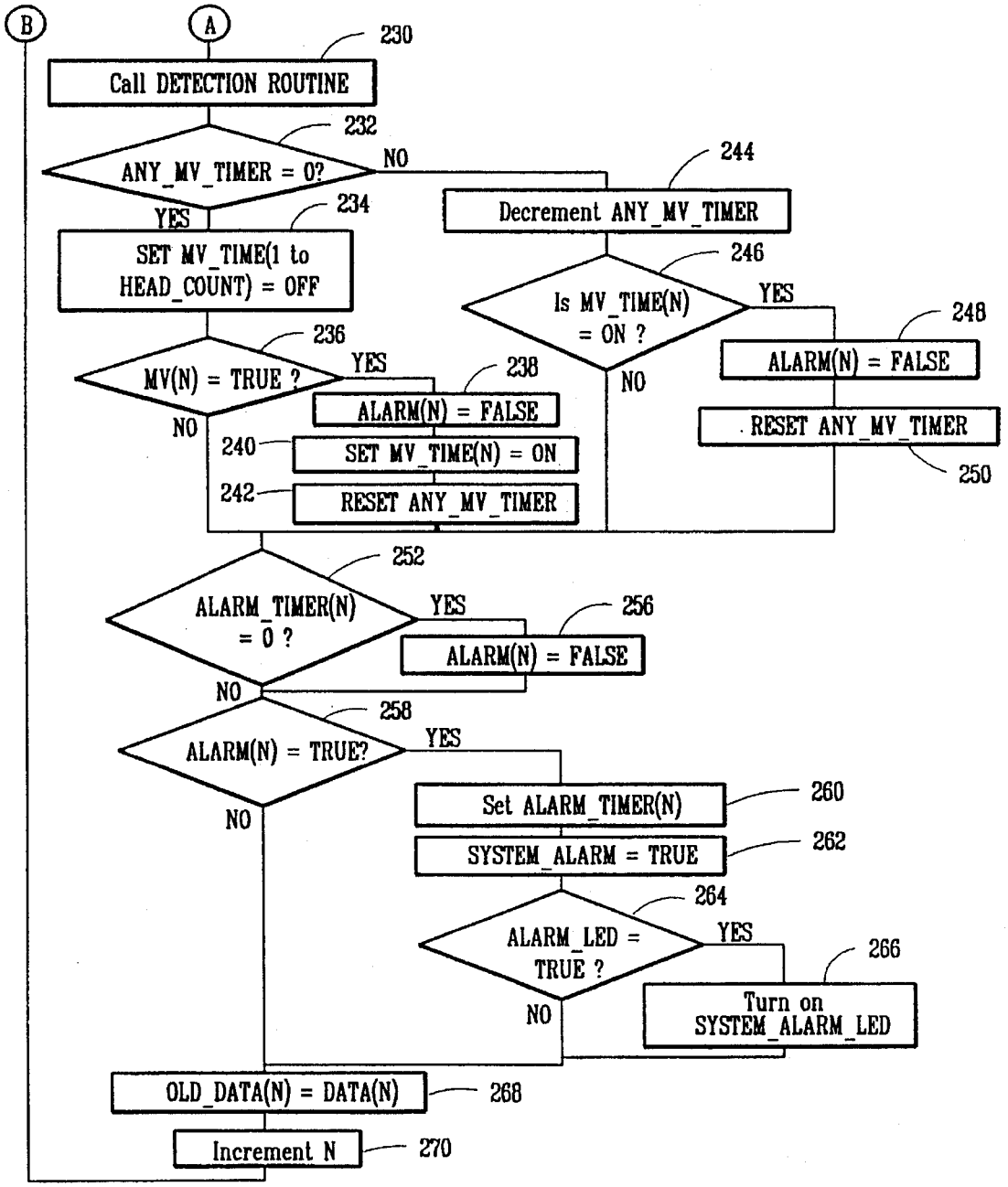

FIG. 10 shows the processing steps performed in the main program routine. In general overview, the main program is a continuously monitoring loop which polls the event detection units and analyzes the signals obtained. The central processor 14 (FIG. 1) may typically include a plurality of analog to digital converter inputs each of such inputs coupled to one of a plurality of event detection units 12 (FIG. 1).

As shown in processing blocks 210–214 an event detection unit is selected and if it is the first selection then the trouble interval time is decremented. In decision block 216 if the event detection unit has no data to report, a next event detection unit is selected. If the event detection unit has data to report then as shown in processing block 218 the data is read from the event detection unit.

In decision block 220, decision is made as to whether the data is abnormal. If decision is made that the data is abnormal then logical flags are set to indicate a problem may exist, otherwise no logical flags are set.

Next, as shown in processing block 224, the statistics routine described above is called. The signals are provided to the signal statistics algorithm wherein the peak-to-peak noise over a measuring period in a moving average are kept in memory. The moving average may be weighted to provide the average having a satisfactory characteristic. For example, cosine weighting provides the current sample having a weighting of one (i.e., cosine (0)) while the nth sample has a weighting corresponding to cosine (n×90/N), where N is the maximum sample.

Thus, a cosine weighting function reduces the significance of a sample in the average as more recent samples are included in the average. That is, as new samples are received, the prior samples move away from the current sample and less weight is accorded the prior sample until the weight and thus effect of the sample becomes zero after N additional samples are included in the measurement.

Those of ordinary skill in the art will recognize of course that other data, weighting criteria, or no weighting may also be used. Since noise signals tend to average to zero, a moving average value which departs significantly from zero indicates that a signal component exists. Noise levels deemed to be pure which are above or below normal may be processed to a trouble output as will be described below.

For example, abnormal DC operating parameters on the current signaling loops are interpreted as line security breaches and are processed to a trouble output. Such abnormal operating parameters on the current signaling loops may be an indication of problems including but not limited to disconnection of the detection sensor unit, severing of connecting cables or removing covers and tampering with an event detection unit.

After a calibration signal has been initiated, the result may be analyzed for deviation from the original factory parameters. If possible, the thresholds may be reset to compensate for any differences between the calibration results and the original parameters.

As shown in decision block 226, at a predetermined time the trouble routine may be called. Subsequently, as shown in processing block 230 a detection routine is called. The detection routine will be described further below in conjunction with FIG. 11.

Once the detection routine has been called the system must account for the mutual verification mode. If the mutual verification timer ANY_MV_TIMER is zero then in processing block 234, the system sets the MV_TIME to the ON condition and thus indicates which event detection unit began the window. Next, as shown in decision block 236, the system checks for a first detection setting by seeing if the logical switch MV(N) is set to true.

If such a setting is found, then as shown in processing blocks 238–242 the alarm is set to false, the MV_TIME is set to the ON condition and the ANY_MV_TIMER is started.

If in decision block 232 the ANY_MV_TIMER is not zero, the ANY_MV_TIMER is decremented in processing block 244 and in decision block 246 the MV_TIME is tested for an ON condition. if the MV_TIME is sets to an ON condition then in processing block 248 the alarm is set to false and in processing block 250 the ANY_MV_TIMER is reset.

If the result of the decision in decision block 246 is an OFF condition, then the alarm is kept true.

Decision block 252 checks to see if the alarm timer has timed out. If the alarm timer has timed out then the second alarm has not occurred within the requisite time from the first alarm and thus as shown in processing block 256 the alarm is set to false. If the alarm timer has not timed out then the alarm is not set to false and processing continues to decision block 258.

In decision block 258 is the alarm is set to true then as shown in processing block 260 the alarm timer is set and the system alarm is set to true. Next as shown in processing block 264 the alarm LED for that particular event detection unit is tested for a true condition. Thus, as shown in processing block 266 the system alarm LED is activated unless the detection information originated from the same detection sensor unit that started the verification window.

Processing then continues to processing blocks 268 and 270 which respectively update the data and select a next event detection unit.

Thus, for a signal to be processed to an alarm output, the signal must have the following characteristics concurrently presented: first, two detections having a prescribed amplitude relationship must be detected, second the two detections must occur within a prescribed time interval or verification window and third, the two detections must have a zero crossing or return to zero between them.

System sensitivity may be changed by increasing the time interval within which event signals must be received. Such an increase in the time interval has the effect of increasing the target velocity range. Furthermore, the system settings for mutual verification may be overlaid. Signals which are recognizably different from an intruder are ignored. Thus, any signals which do not have all of the above characteristics are ignored.

Figure 11:
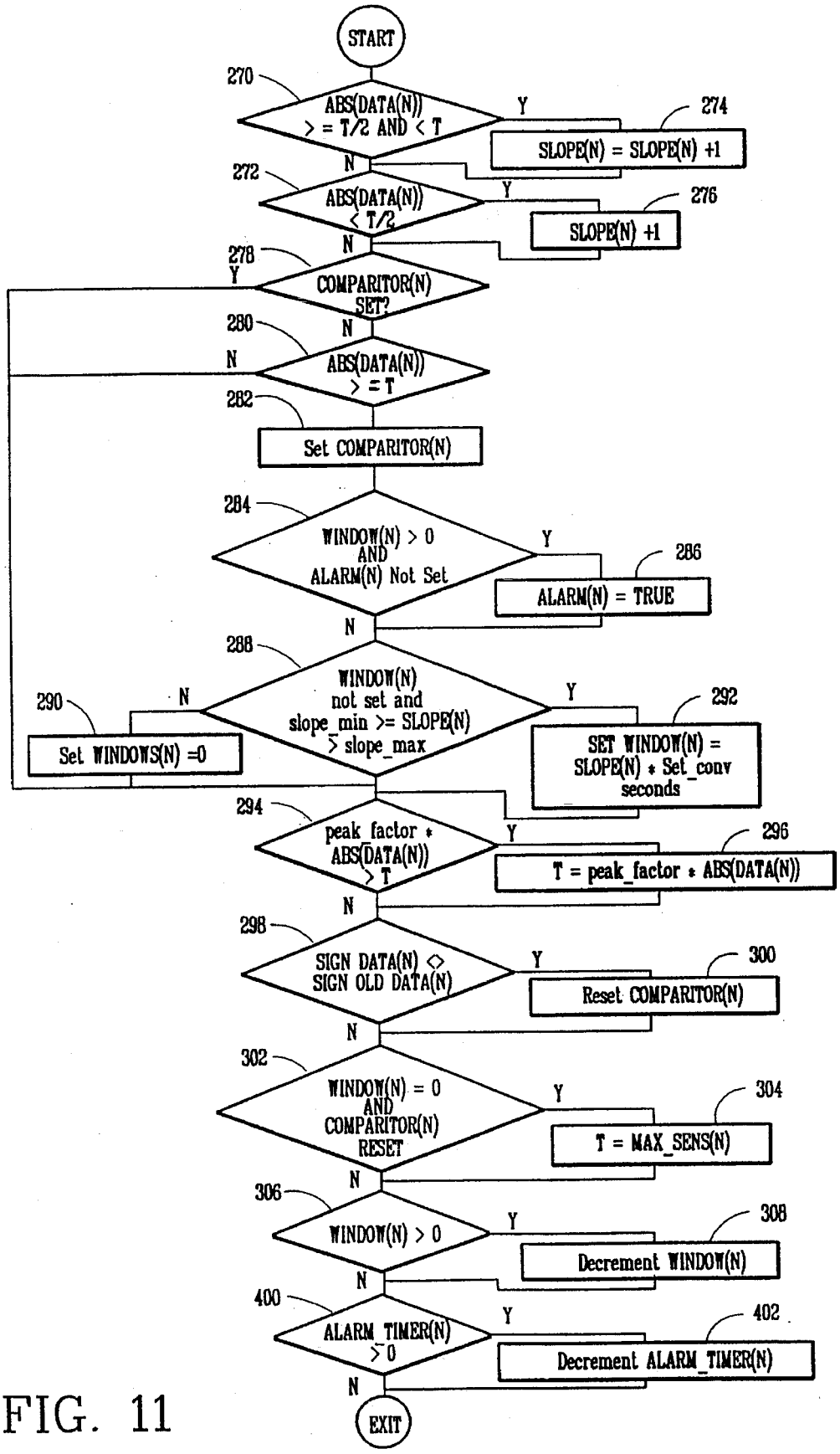
FIG. 11 is a flow diagram of the processing performed in a central processor according to one embodiment of the invention to compute a detection value.

Referring now to FIG. 11, the processing steps performed in the central processor of FIG. 1 to compute detection parameters are shown. In general overview, it should be noted that the variables provided to and from the detection algorithm pertain to the data from the event detection unit being currently processed. The results for each detection sensor unit are stored independently. Thus, each detection sensor unit behaves as a separate sensor.

In decision blocks 270, 274 the detection routine receives data from an event detection unit and compares the data to the threshold value T. Depending on the value of the data, a slope value between T/2 and T is set as shown in processing blocks 274, 276.

In decision block 278 decision is made base on whether the first detection indicator is set. If the first detection indicator is set then processing flows decision block 294 and processing block 296 where the threshold may be dynamically updated based on the value of the current data.

If the first detection indicator is not set, then as shown in decision block 280 the data value DATA is compared to the threshold value T. If the data value is less than the threshold value then the first detection indicator is not set and, as shown, processing continues to decision block 294. If the data value is greater than or equal to the threshold value then the first detection indicator is set. and processing continues to decision block 284.

In processing block 284, if the window for detection has not closed and the alarm state is not set then as shown in processing block 286 the alarm, state is set to a logical true value. In decision block 288 if the window for detection and slope of the data are not provided having predetermined values then as shown in processing block 290 the window time is set to zero and processing continues to decision block 294. Alternatively, in decision block 288 if the window for detection and slope of the data are have predetermined values then as shown in processing block 292 a window time is computed and processing continues to decision block 294.

In decision block 294 the product of a factor used to set the dynamic threshold PEAK_FACTOR and the DATA are compared with the threshold value T. If the product is greater than the threshold then as shown in processing block 296 a new threshold corresponding to the product is provided.

A target traversing the field of view of a dual element detector, provided a reversal of polarity as a function of its motion. Thus, in decision block 298 if the arithmetic sign of the old data and the new data are not equal then the comparator value is reset as shown in processing block 300.

In decision blocks 306 and 400 the window for detection and the alarm timer are checked and, as shown in processing blocks 308 and 402, the detection window and alarm timer are decremented as appropriate before the subroutine terminates.

Modifications and substitutions by one of ordinary skill in the art are considered to be within the scope of the present invention, which is not to be limited except by the claims which follow.

I claim:

1. An event detection system with centralized signal processing and dynamically adjustable detection threshold, comprising:

a plurality of event detection units, each of said plurality of event detection units including:

at least one event detector, for providing an event signal having a variable value, said event signal indicating the detection of an event; and a single, centralized signal processing unit, coupled to each of said plurality of event detection units, said centralized signal processing unit including:

at least one event detection signal processor, for processing said event signal, said at least one event detection signal processor including:

a comparator, for comparing the value of said event signal with a dynamically adjustable threshold value having a predetermined initial value, and for providing a first detection signal upon the value of said event signal exceeding the initial value of said dynamically adjustable threshold value;

a threshold generator, responsive to said event signal and to a predetermined offset value, for adjusting the value of said dynamically adjustable threshold, and for providing an adjusted threshold value to said comparator upon the value of said event signal exceeding said predetermined offset value, said adjusted threshold value increasing as a function of increases in value of said event detection voltage signal;

said comparator providing a second, confirming detection signal upon said event signal exceeding the value of said adjusted threshold value; and alarm apparatus, responsive to said second, confirming detection signal, for providing an indication of a detected and confirmed event;

each of said plurality of event detection units further comprises a current signal source, coupled to said event detector and responsive to said event signal, for providing an event detection current signal; and said centralized signal processing unit further comprises a plurality of current-to-voltage signal converters, each of said plurality of current-to-voltage signal converters responsive to one of said event detector current signals provided by one of said event detection unites, for converting said event detection current signal to an event detection voltage signal having a corresponding value.

2. The event detection system of claim 1 wherein said at least one event detection signal processor further includes:

at least one alarm timer, responsive to said first detection signal from said comparator, for providing an alarm activation period signal during which an alarm signal may be generated; and an alarm activator, responsive to said alarm activation period signal and to said second, confirming detection signal, for providing an alarm signal activating said alarm apparatus, for indicating an event has been detected and confirmed.

3. The event detection system of claim 2 wherein said at least one event detection signal processor corresponds to a voltage detection signal processor.

4. The event detection system of claim 1 further including:

a mutual event verifier, responsive to at least one mutual verification event detection unit selector signal, for establishing at least one of said plurality of event detection units as a mutual verification event detection unit, and for activating said alarm apparatus only upon the concurrence of a second, confirming detection signal from said at least one event detection unit established as a mutual verification event detection unit, and a second, confirming detection signal from any other event detection unit coupled to said event detection system.

5. The event detection system of claim 4 wherein said mutual event verifier includes:

a plurality of mutual event occurrence timers, each of said plurality of mutual event occurrence timers responsive to a second, confirming detection signal from an associated event detection unit, and responsive to a mutual verification event detection unit selector signal, for providing a mutual event detection period signal having a predetermined duration, and during which said alarm apparatus may be activated; and a mutual event detector, coupled to said plurality of mutual event occurrence timers, and responsive to at least one mutual event detection period signal and to said mutual verification event detection unit selector signal, for activating said alarm apparatus upon the concurrence of said mutual event detection period signal generated by an established mutual verification event detection unit and a second, confirming event detection signal from at least any other one of said plurality of event detection units.

6. The event detection system of claim 5 wherein said single centralized signal processor unit further includes:

a mutual event detection unit selector, for providing said mutual verification event detection unit selector signal establishing at least one of said plurality of event detection units as a mutual verification event detection unit.

7. The event detection system of claim 6 wherein said plurality of remotely located event detection units include at least one heat detection unit.

8. The event detection system of claim 6 wherein said plurality of remotely located event detection units include at least one intrusion detection unit.

9. The event detection system of claim 6 wherein said plurality of remotely located event detection units include at least one smoke detection unit.

10. The event detection system of claim 1 wherein each of said plurality of event detection units is a remotely located event detection unit and said single, centralized signal processing unit includes one event detection voltage signal processor for each one of said plurality of remotely located event detection units.

11. The event detection system of claim 1 wherein each of said plurality of event detection units is a remotely located event detection unit and said single centralized signal processing unit detects tampering with any one of said plurality of remotely located event detection units.

12. The event detection system of claim 1 wherein each of said plurality of event detection units is a remotely located event detection unit and said single centralized signal processing unit detects tampering with a cable interconnecting each of said plurality of remotely located event detection units and said single centralized signal processing unit.

13. The event detection system of claim 1 wherein said alarm apparatus provides a visual indication of a detected and confirmed event.

14. The event detection system of claim 1 wherein said alarm apparatus provides an audible indication of a detected and confirmed event.

15. An event detection system with centralized signal processing and dynamically adjustable detection threshold, comprising:

a plurality of remotely located event detection units, each of said plurality of remotely located event detection units including:

at least one event detector, for providing an event signal having a variable value, said event signal indicating the detection of an event; and a current signal source, coupled to said event detector and responsive to said event signal, for providing an event detection current signal;

a single, centralized signal processing unit, coupled to each of said plurality of remotely located event detection units, said centralized signal processing unit including:

a plurality of current-to-voltage signal converters, each of said plurality of current-to-voltage signal converters responsive to one of said event detector current signals provided by one of said event detection units, for converting said event detection current signal to an event detection voltage signal having a corresponding value; and at least one event detection voltage signal processor, for processing said event detection voltage signal, said at least one event detection voltage signal processor including:

a comparator, for comparing the value of said event detection voltage signal with a dynamically adjustable threshold value having a predetermined initial value, and for providing a first detection signal upon the value of said event detection voltage signal exceeding the initial value of said dynamically adjustable threshold;

a threshold generator, responsive to said event detection voltage signal and to a predetermined offset value, for adjusting the value of said dynamically adjustable threshold, and for providing an adjusted threshold value to said comparator upon the value of said event detection voltage signal exceeding said predetermined offset value, said adjusted threshold value increasing as a function of increases in value of said event detection voltage signal;

said comparator providing a second, confirming detection signal upon said event detection voltage signal exceeding the value of said adjusted threshold value;

a mutual event detection unit selector, for providing at least one mutual verification event detection unit selector signal establishing at least one of said plurality of event detection units as a mutual verification event detection unit;

a mutual event verifier, responsive to said at least one mutual verification event detection unit selector signal, for providing an alarm activation signal only upon the concurrence of a second, confirming detection signal from said at least one event detection unit established as a mutual verification event detection unit, and a second, confirming detection signal from any other event detection unit coupled to said event detection system; and alarm apparatus, responsive to said alarm activation signal, for providing an indication of a mutually verified confirmed event.

16. An event detection system with centralized signal processing and dynamically adjustable detection threshold, comprising:

a plurality of remotely located event detection units, each of said plurality of remotely located event detection units including:

at least one event detector, for providing an event signal having a variable value, said event signal indicating the detection of an event; and a current signal source, coupled to said event detector and responsive to said event signal, for providing an event detection current signal;

a single, centralized signal processing unit, coupled to each of said plurality of remotely located event detection units, said centralized signal processing unit including:

a plurality of current-to-voltage signal converters, each of said plurality of current-to-voltage signal converters responsive to one of said event detector current signals provided by one of said event detection units, for converting said event detection current signal to an event detection voltage signal having a corresponding value; and at least one event detection voltage signal processor, for processing said event detection voltage signal, said at least one event detection voltage signal processor including:

a comparator, for comparing the value of said event detection voltage signal with a dynamically adjustable threshold value having a predetermined initial value, and for providing a first detection signal upon the value of said event detection voltage signal exceeding the initial value of said dynamically adjustable threshold;

a threshold generator, responsive to said event detection voltage signal and to a predetermined offset value, for adjusting the value of said dynamically adjustable threshold, and for providing an adjusted threshold value to said comparator upon the value of said event detection voltage signal exceeding said predetermined offset value, said adjusted threshold value increasing as a function of increases in value of said event detection voltage signal;

said comparator providing a second, confirming detection signal upon said event detection voltage signal exceeding the value of said adjusted threshold value;

a mutual event detection unit selector, for providing at least one mutual verification event detection unit selector signal establishing at least one of said plurality of event detection units as a mutual verification event detection unit;

a mutual event verifier, responsive to said at least one mutual verification event detection unit selector signal, for providing an alarm activation signal only upon the concurrence of a second, confirming detection signal from said at least one event detection unit established as a mutual verification event detection unit, and a second, confirming detection signal from any other event detection unit coupled to said event detection system;

said mutual event verifier including:

a plurality of mutual event occurrence timers, each of said plurality of mutual event occurrence timers responsive to a second, confirming detection signal from an associated event detection unit, and responsive to a mutual verification event detection unit selector signal, for providing a mutual event detection period signal having a predetermined duration, and during which said alarm apparatus may be activated; and a mutual event detector, coupled to said plurality of mutual event occurrence timers, and responsive to at least one mutual event detection period signal and to said mutual verification event detection unit selector signal, for providing said alarm activation signal upon the concurrence of said mutual event detection period signal generated by an established mutual verification event detection unit and a second, confirming event detection signal from at least any other one of said plurality of event detection units; and alarm apparatus, responsive to said alarm activation signal, for providing an indication of a mutually verified event.

17. A method of mutual event verification utilizing an event detection system with centralized signal processing and dynamically adjustable detection threshold, the method comprising:

receiving an event voltage signal having a variable value, said event voltage signal indicating the detection of an event by a remotely located event detection unit;

converting said event voltage signal to an event detection current signal by said remotely located event detection unit;

processing said event detection current signal by a single, centralized signal processor, said processing comprising the steps of:

converting said event detection current signal into an event detection voltage signal having a particular value;

comparing the particular value of said event detection voltage signal with a dynamically adjustable threshold value having a predetermined initial value;

providing a first detection signal upon the value of said event detection voltage signal exceeding the initial value of said dynamically adjustable threshold;

adjusting the value of said dynamically adjustable threshold upon the value of said event detection voltage signal exceeding a predetermined offset value, and for providing an adjusted threshold value;

comparing the event detection voltage signal to the adjusted threshold value;

providing a second, confirming detection signal upon the value of the event detection voltage signal exceeding the value of the adjusted threshold value; and establishing at least one remotely located event detection unit as a mutual verification event detection unit; and activating an alarm apparatus only upon the concurrence of a second, confirming detection signal from an established mutual verification event detection unit, and a second, confirming detection signal from any other remotely located event detection unit coupled to the event detection system.

* * * * *